United States Patent [19]

Johnson

[11] 4,116,437

[45] Sep. 26, 1978

[54] TENNIS TRAINING AND RATING APPARATUS

[76] Inventor: Neil E. Johnson, Three Woodbridge Ave., New Monmouth, N.J. 07748

[21] Appl. No.: 330,467

[22] Filed: Feb. 8, 1973

[51] Int. Cl.[2] ..... A63B 6/00

[52] U.S. Cl. ..... 273/29 A; 273/181 J

[58] Field of Search ..... 73/79, 379, 13; 273/184 R, 29 A, 185 R, 185 A, 185 B, 181 R, 181 H, 181 J, 181 G, 102.1 B, 102.1 C, 102.1 F, 102.1 G, 102.2 A, 183 R, 102.2 B, 26 R, 29 R, 30

[56] References Cited

U.S. PATENT DOCUMENTS

| | | | |
|---|---|---|---|
| 2,087,575 | 7/1936 | Littell et al. | 273/29 A |
| 3,082,005 | 3/1963 | Kron | 273/181 R |
| 3,508,440 | 4/1970 | Murphy | 273/184 R |
| 3,513,707 | 5/1970 | Russell et al. | 273/181 R |
| 3,784,207 | 1/1974 | Gentiluomo | 273/181 H |

*Primary Examiner*—Richard C. Pinkham

*Assistant Examiner*—T. Brown

*Attorney, Agent, or Firm*—Charles E. Baxley

[57] ABSTRACT

A tennis training and rating apparatus comprises one or more ball delivery devices for delivering tennis balls past a net into a playing area so that a player may return the balls back over the net against a target assembly. The target assembly is composed of a series of target sections each of which is actuated when struck by a tennis ball to provide a corresponding output signal representing accuracy of placement of the return shot and the output signals are fed to a target area recorder which records the signals. A speed sensing system senses the speed of each tennis ball as it is returned over the net against the target assembly and provides an appropriate speed signal which is delivered to a speed recorder which records the speed signals. A computer device receives the signals from both the target area recorder and the speed recorder and computes the player's score based upon accuracy of placement and speed of the return shots.

2 Claims, 2 Drawing Figures

TENNIS TRAINING AND RATING APPARATUS

INVENTION

Figure 1:
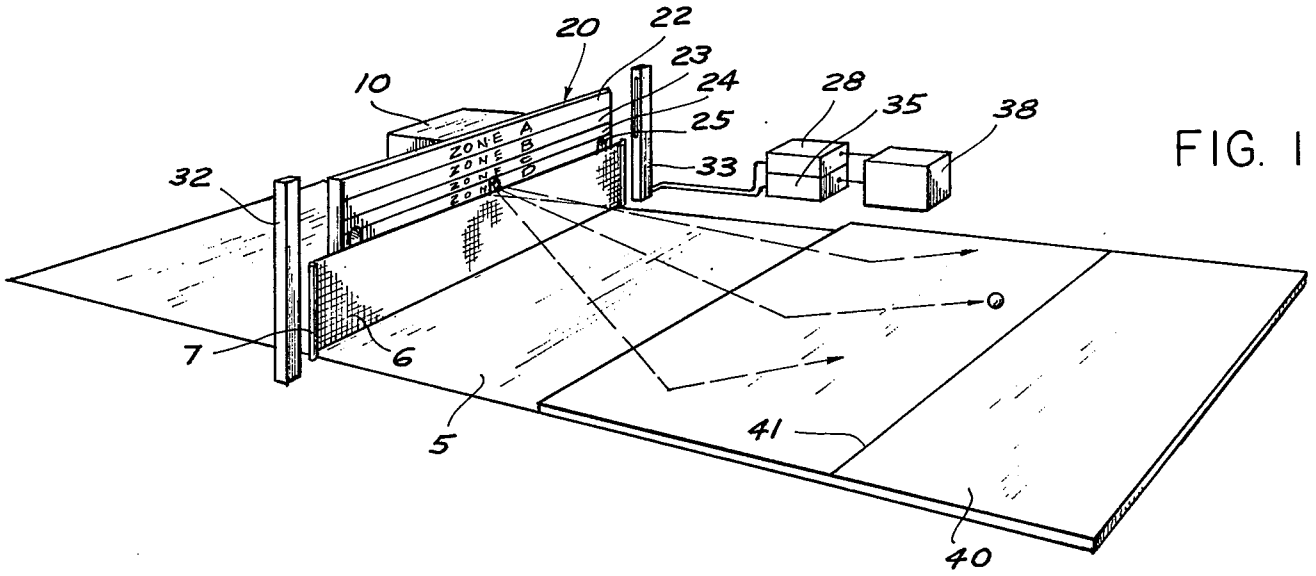

The present invention relates generally to tennis training apparatus and more particularly to tennis training apparatus designed to enable a player to practice and evaluate either his forehand, backhand or serve.

Numerous types of tennis training apparatus have been developed for enabling a player to practice various aspects of the tennis game but no apparatus has heretofore been developed which enables a player to practice and evaluate all aspects of the game. Thus the prior art apparatus are limited as to the extent of training and rating they can provide and usually are quite easy to master without affording the player the proper amount of training and without permitting suitable rating.

It is therefore a primary object of the present invention to provide a tennis training and rating apparatus which enables a player to practice and evaluate his forehand, backhand and/or serve.

It is another object of the present invention to provide a tennis tracking and rating apparatus which is capable of delivering tennis balls from various points of origin and at various speeds to provide the player with a wide diversity of practice and rating shots.

It is yet another object of the present invention to provide a tennis training and rating apparatus which senses both the accuracy of placement of the return shot as well as the speed of the return shot and which provides corresponding output signals to enable a player to evaluate his performance as well as to compare objectively his performance with those of others.

It is still another object of the present invention to provide a tennis training and rating apparatus which may be used either in conjunction with a regulation size tennis court or at any other location which is of sufficient size to approximate a playing area.

The above and other objects are carried out by a tennis court, tennis training and rating apparatus comprising a ball delivery device for delivering tennis balls at preselected speeds and at prescribed intervals past a net, a ball-accuracy sensing system having a target for the player to aim at as he returns the balls over the net and for sensing the accuracy of the return shots, a speed sensing system for sensing the speed of the return shots, and a computer device for computing the player's score and evaluating his performance.

Figure 2:
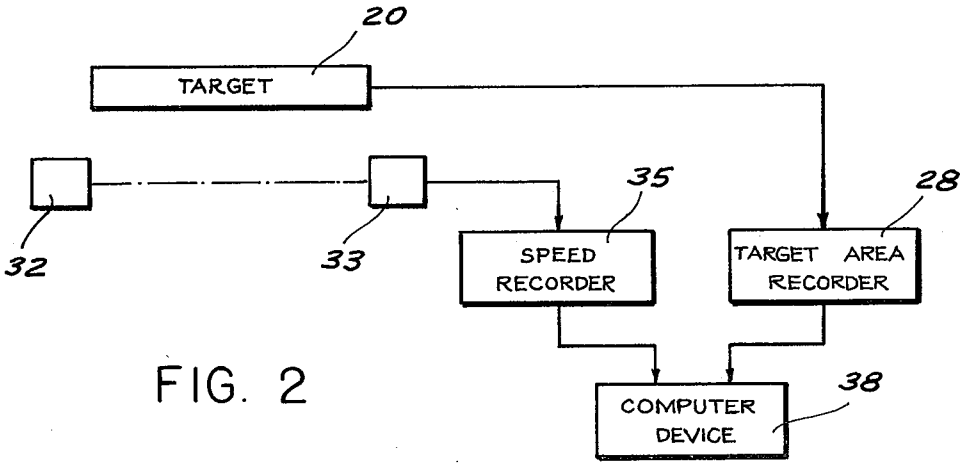

Other objects will become apparent to those ordinarily skilled in the art upon a reading of the following specification and claims when read in conjunction with the following drawings, wherein like reference characters denote like parts in the various views, and wherein:

FIG. 1 is a perspective view of a tennis training and rating apparatus according to the present invention; and FIG. 2 is a block diagram of essential components of the tennis training and rating apparatus of the present invention.

The tennis training and rating apparatus of the present invention is shown in FIG. 1 in conjunction with a regulation size tennis court. The tennis court has a playing area 5 divided into two equal playing areas by a net 6. The net is strung between a pair of poles 7 or other similar supports in a well known manner.

The tennis training and rating apparatus comprises one or more ball delivery devices, a ball-accuracy sensing system, a ball-speed sensing system and a computer device. The ball delivery devices 10 are positioned on one side of the net 6 and function periodically to deliver tennis balls past the net into the opposing playing area in a manner similar to that of a tennis stroke made by an actual opposing player. One delivery device is shown in the drawings and the same may be positioned at either end of the net or at the center of the net (as shown) to vary the origin of delivery of the balls or alternatively, several delivery devices may be used and positioned along the net at desired locations to deliver the balls from various points of origin. The ball delivery devices 10 are of known construction and may be, for example, of the type disclosed in U.S. Pat. No. 2,313,409 to Walker. The speed of delivery of each tennis ball, the loft of the ball, and the point at which the ball lands in the opposing playing area may be regulated so that the ball delivery device simulates the various types of tennis strokes encountered under actual playing conditions.

The ball-accuracy sensing system comprises a target assembly 20 having a predetermined target area and a target area recorder 28. The target assembly is composed of a portable support structure which is mounted on casters or the like to facilitate its positioning in place and a series of rectangular target sections 22, 23, 24 and 25. Each target section is mounted upon the support structure for actuating movement independently of the others and biasing springs are employed to normally maintain the sections in a rest state and to return them to the rest state after being actuated by a tennis ball.

As seen in FIG. 1, the target sections each have a ball-striking surface on which the returned balls may strike and the sections are disposed in vertically superposed relationship one above the other such that the lowermost target section 25 is situated immediately above the level of the net 6 and the remaining target sections 24, 23 and 22 are respectively situated at progressively farther levels above the net. For each ball returned over the net, the closer the ball is to the top edge of the net, the more accurate is the return shot. In order to take into account the degree of accuracy of the return shot, the target section 25 along with the next adjacent section 24 are narrower in width than the sections 23 and 22 thereby making it more difficult to hit the narrower sections as opposed to hitting the wider sections 23 and 22.

The target sections define the target area and contain marking indicia on their front face to indicate the relative scoring value obtained by returning the tennis ball against the various sections. The target section 22 is marked ZONE A and the target sections 23, 24 and 25 are respectively marked ZONE B, ZONE C and ZONE D and preselected point values of successively increasing numerical value are assigned to the target sections as described hereinafter.

A sensing circuit is connected to the support structure for providing an output accuracy signal whenever a tennis ball strikes and actuates one of the target sections. The sensing circuit preferably comprises a series of normally open circuits each disposed behind one of the target sections and each having a different value resistor whose resistance is proportional to the numerical value assigned to its associated target section. Each normally open circuit is connected to a source of electrical energy and has a switch which is closed in response to actuating movement of its associated target section thereby temporarily to close the circuit and permit current to flow therein. The voltage drop across each resistor is measured to obtain an electrical output accuracy signal having a magnitude representative of the particular target section which has been struck by the tennis ball.

The electrical output signals are fed to the target area recorder 28 which records the signals to obtain recorded information representative of the number of times each particular target section is hit by tennis balls per each round of play. A record is thus obtained of the player's skill and accuracy in returning tennis balls over the net and for each return shot that is accurately placed over the net, the tennis ball will strike one of the target sections causing actuation of that particular section whereupon an appropriate output accuracy signal will be developed and fed to the target area recorder 28.

In accordance with a further aspect of the present invention, a ball-speed sensing system is positioned preferably in the vicinity of the net 6 for sensing automatically the speed of those balls returned by the player which strike the target assembly 20. The ball-speed sensing system includes a speed sensing device 32, 33 for sensing the speed of the ball and a speed recorder 35 for recording the sensed speed.

The speed sensing device comprises a photoelectric sensing device comprising a light-sending unit 32 and a light-sensing unit 33. The light-sending unit 32 is positioned on one side of the court and emits and directs electromagnetic radiation across the court in a spatial zone similar in size to that occupied by the target sections 22–25. The light-sensing unit 33 is positioned on the other side of the court and includes vertical banks of light-sensitive elements which receive the electromagnetic radiation and develop corresponding output signals. For example, the sending unit 32 could include a vertically disposed tubular light bulb or a vertically arranged row of individual light bulbs and the sensing unit 33 could include vertically arranged rows of photocells, photoresistive elements or the like.

Since the tennis training apparatus of the invention will most often be used outdoors where it is quite bright, it is preferable to employ electromagnetic radiation in the infrared or ultraviolet spectrums rather than the visible light spectrum in order to minimize the detrimental effects of the sunlight and such sending units are known in the prior art and will not be further discussed here. A shield may also be disposed about the light-sensitive elements to shield same from the unwanted effects of ambient light. It is to be understood that the tennis training and rating apparatus of the invention may also be used indoors as well as outdoors and no modification of the apparatus is necessary regardless of the playing site.

During operation of the sending unit 32 and the sensing unit 33, the light source within the sending unit is energized and electromagnetic radiation is directed across the court in a spatial zone completely overlying the front of the target sections. The electromagnetic radiation is received by the sensing unit 33 which responds to the radiation and develops an appropriate electrical output signal. The signal is the reference signal or background signal and represents the condition when no object is disposed in the path of travel of the electromagnetic radiation.

When a tennis ball is delivered by one of the ball delivery devices 10 into the playing area and the player returns the ball over the net and against the target assembly 20, the ball passes momentarily through the electromagnetic beam and the beam is interrupted temporarily thereby causing a change or modulation in the amount of radiation reaching the sensing unit 33. The time duration in which the ball interrupts the electromagnetic beam is proportional to the change in the output signal developed by the sensing unit 33 and therefore the output signal will be a function of the speed of the ball as it travels over the net and such a modulated signal is referred to as an output speed signal. If the ball is traveling relatively slowly, it will block the electromagnetic beam for a longer time than it would if the ball was traveling relatively quickly and the time that the portion of the electromagnetic beam is interrupted by the ball will be reflected in the change in the output signal from its reference level.

The speed recorder 35 is connected to the sensing unit 33 and continuously receives the output signal therefrom. The speed recorder records the output speed signal whenever the same differs from the reference level by a given amount whereby the sensing unit 35 delivers a succession of output pulses each having a duration proportional to the speed of the ball as it is returned over the net. The pulses are then fed to the speed recorder 35 which records the pulse signals to obtain recorded information representative of the actual speed of the balls.

The outputs from the target area recorder 28 and the speed recorder 35 are fed to a computer device 38 which automatically computes the total score the player achieves during one round of play and delivers a corresponding readout. The computer device is programmed to weight properly the signals from the target area recorder and the speed recorder and compute a score which takes into account the speed of the ball delivered by each ball delivery device 10, the speed of the ball returned by the player, and the accuracy of the return shot.

The tennis training and rating apparatus of the present invention may also be used independently of a tennis court and for this purpose, a solid mat 40 is provided. The mat 40 constitutes a bounce area for the ball delivered by the ball delivery device 10 and the mat may be formed of a material which simulates a court surface. When the tennis training and rating apparatus is used without aid of a tennis court, all that need be done is to position the ball delivery device 10, the target assembly 20, and the ball-speed sensing system in their operating positions relative to an imaginary tennis net. Next, the mat 40 is positioned in spaced-apart relationship from the imaginary net such that the distance between the imaginary net and a base line marking 41 on the mat is equal to the regulation distance between the net and the base line in a regulation size tennis court.

In this instance, any balls which are returned by the player beneath the lowermost target section 22 would not contact the target assembly 20 at all and instead, would pass beneath the target assembly and accordingly would not be sensed by the speed sensing system. Preferably, some kind of screen or other ball-catching member should be suspended behind the target assembly in order to catch any tennis balls which are hit too low to strike the target sections.

The operation of the tennis training apparatus used in conjunction with a regulation tennis court will now be described with reference to FIG. 1. First one of the ball delivery devices 10 is positioned at the desired location along the net 6 and adjusted to select the desired speed of delivery, direction of delivery and degree of loft of the balls. The device is then actuated to deliver a succession of tennis balls past the net 6 into the opposing playing area and the player then attempts to return each ball over the net into the target area of the target assembly 20. Each ball that is returned over the net and against one of the target sections 22–25 passes through the electromagnetic beam and the speed of the ball is sensed by the sensing unit 33 and recorded by the speed recorder 35. In addition, each ball striking the target area of the target assembly 20 actuates the struck target section thereby providing an output accuracy signal indicative of the accuracy of the return shot and the output signal is recorded by the target area recorder 28. The computer device 38 receives the recorded information from both the speed recorder and the target area recorder and computes the total score obtained by the player for one round of play based upon the accuracy and speed of the return shots.

The tennis training apparatus of the present invention is suited ideally for enabling a player to practice his forehand and backhand as well as his serve. In order to practice either the forehand or backhand, the player assumes a stance behind the baseline and then returns a predetermined number of balls using both his forehand and his backhand and signals representing both the accuracy and speed of the returned balls are recorded and fed to the computer which determines the player's score. In order to practice the serve, the player serves a predetermined number of balls over the net into the target assembly and signals representing both the accuracy and speed of the served balls are recorded and fed to the computer which computes the player's score.

Obvious modifications and different applications of the device will be apparent to those skilled in the art and the present invention is intended to cover variations falling within the scope and spirit of the invention as defined in the appended claims.

I claim:

1. A tennis training and rating apparatus comprising: a playing area having opposite ends; ball-delivering means for individually delivering tennis balls into said playing area so that they may be returned by a player during use of the apparatus; a tennis net disposed on said playing area transversely thereof; and ball-accuracy sensing means for sensing the accuracy of placement of the tennis balls returned by the player against a predetermined target area positioned in a plane corresponding to the plane of said tennis net, and providing an output accuracy signal having a value dependent upon which portion of the target area the ball strikes, said target area comprising a plurality of individual target sections each having a ball-striking surface on which the returned balls initially strike on the fly and before bouncing when hitting said target area and each mounted for actuation independently of the others, means mounting said plurality of target sections in vertically superposed relationship one above the other with their corresponding ball-striking surfaces lying in vertical superposition and substantially aligned in the plane of said tennis net, and means for providing a different output accuracy signal in response to actuation of each target section including means for providing a signal having a different value in response to actuation of each target section.

2. The tennis training apparatus according to claim 1; including a mat positionable on the ground to define a bounce area for receiving thereon the tennis balls delivered from said ball delivering means.

* * * * *